US008513316B2

(12) United States Patent
Gueh

(10) Patent No.: US 8,513,316 B2
(45) Date of Patent: Aug. 20, 2013

(54) HYDROCARBON SYNTHESIS AND PRODUCTION ONBOARD A MARINE SYSTEM USING VARIED FEEDSTOCK

(76) Inventor: How Kiap Gueh, Singapore (SG)

( * ) Notice: Subject to any disclaimer, the term of this patent is extended or adjusted under 35 U.S.C. 154(b) by 93 days.

(21) Appl. No.: 12/920,281

(22) PCT Filed: Feb. 27, 2009

(86) PCT No.: PCT/SG2009/000074

§ 371 (c)(1),
(2), (4) Date: Aug. 30, 2010

(87) PCT Pub. No.: WO2009/108134

PCT Pub. Date: Sep. 3, 2009

(65) Prior Publication Data

US 2011/0003899 A1 Jan. 6, 2011

(30) Foreign Application Priority Data

Feb. 29, 2008 (SG) ..... 200801759

(51) Int. Cl.
*C07C 1/04* (2006.01)

(52) U.S. Cl.
USPC ..... 518/702

(58) Field of Classification Search
USPC ..... 518/702
See application file for complete search history.

(56) References Cited

U.S. PATENT DOCUMENTS

| | | | | |
|---|---|---|---|---|
| 6,211,255 | B1 * | 4/2001 | Schanke et al. | 518/715 |
| 6,225,358 | B1 | 5/2001 | Kennedy | |
| 6,262,131 | B1 | 7/2001 | Arcuri et al. | |
| 6,277,894 | B1 * | 8/2001 | Agee et al. | 518/700 |
| 6,797,243 | B2 | 9/2004 | Arcuri et al. | |
| 7,037,947 | B2 * | 5/2006 | Font Freide et al. | 518/700 |
| 2005/0106086 | A1 | 5/2005 | Tomlinson et al. | |
| 2006/0189702 | A1 | 8/2006 | Tomlinson et al. | |

FOREIGN PATENT DOCUMENTS

| | | | |
|---|---|---|---|
| WO | WO 0138269 | A1 * | 5/2001 |
| WO | WO 02/066577 | A2 | 8/2002 |

* cited by examiner

*Primary Examiner* — Yong Chu
(74) *Attorney, Agent, or Firm* — Edwin D. Schindler

(57) ABSTRACT

A process for producing Fischer-Tropsch hydrocarbon products onboard a marine vessel from carbonaceous feedstock by gasification in a thermal conversion plant connected to an onboard power plant unit includes the steps of forming Fischer-Tropsch hydrocarbons in a Fischer-Tropsch reactor having a recycle line from the Fischer-Tropsch reactor to the thermal conversion plant and recycling at least one of carbon dioxide and tail gas from the Fischer-Tropsch reactor to the thermal conversion plant during gasification.

6 Claims, 1 Drawing Sheet

HYDROCARBON SYNTHESIS AND PRODUCTION ONBOARD A MARINE SYSTEM USING VARIED FEEDSTOCK

FIELD OF THE INVENTION

The present invention relates to marine systems and/or marine vessels equipped with a plant to produce synthetic fuels and or hydrocarbon products from a carbon containing feedstock (also known as carbonaceous feedstock).

BACKGROUND OF THE INVENTION

Currently, there is an unprecedented global demand for energy for industrial and economic development in several high growth regions of the world, and this demand has exceeded in many instances the total capacity of production of fossil-derived energy sources including crude, natural gas, and coal.

When alternative energy sources are factored into the energy supply/demand equilibrium, that is, nuclear, biomass, wind, solar, geothermal and hydro derived energy pools, it is still possible that demand exceeds production capacity. Fossil energy sources are now increasingly explored and mined in far-flung regions that is substantially further away from its demand markets, and in some circumstances, these energy sources are discovered in regions where overall operating environments may be difficult. In the field of natural gas exploration and development, substantial technology has been developed for gas liquefaction to convert natural gas into denser liquefied natural gas (LNG), or directly into hydrocarbons that is easier to transport using marine vessels.

These hydrocarbons may include methanol, light olefins, gasoline, diesel, heavy wax fuels etc. Upstream technologies developed for the oil industry include marine vessels (offshore oil rigs, submersible platforms, etc.) that can drill to depths that was not possible just one decade ago, and various downstream technologies such as dedicated floating production storage and offloading (FPSO) vessels that can perform a variety of refinery and storage functions.

While the energy environment remains competitive and at times challenging, great potential can be found in still unexplored areas of the world include the Arctic/polar regions where undiscovered oil and gas reserves are estimated at 25% of total world supplies. Significant developments have also been made in the areas of tar sands and shale oil recovery to yield syncrude (synthetic crude).

Additionally, a gradual realization of an apparent acceleration of rising temperatures in almost every major part of the world have convinced many that the continued use and subsequent pollution of heat trapping gases such as carbon dioxide ($CO_2$) cannot be reasonably sustained without dramatic implementation of technologies in the area of environmental regulation, emissions control, carbon sequestration/storage, and simply using fuels that are derived from renewable resources.

It is now estimated that a small elevation in global median temperatures can trigger varying amounts of flooding and sea level readjustments especially to coastal regions, and with large number of urban population centers also located at these places, along with their industrial infrastructure including power generation, transport, factories and manufacturing plants, this presents a potentially massive shift in locating these critical facets of the industrialized states to locations where the mentioned effects are less pronounced.

Marine vessels ranging from container ships that can travel between continents and vast distances to maritime vessels that are simply moored or anchored to body of water, such as storage platforms or ships that can function of depositories for energy assets such as crude oil, or to conduct drilling of energy reserves found deep within the depths of the sea. In addition to ships that either perform transportation of energy, there are vessels that can drill and extract energy, and further "production" vessels that can convert the extracted energy such as natural gas, into denser or more suitable forms, such as methanol, LNG, etc.

Molten metal, especially molten iron, molten metal melts, baths are well known and are used as gasifiers. High temperatures in such baths rapidly decompose, by thermal action, a variety of solid, liquid and gaseous feedstock into hydrogen and/or carbon oxides—the gas product is also known as syngas, comprising hydrogen and carbon oxides (mainly CO).

Such a molten metal gasification system, if operated on terrestrial land, would require large quantities of cooling water, and in some cases, availability of cooling water can result in operational failure or safety hazards if operating temperatures are not properly regulated. Economically, a cooling system on such a terrestrial gasification system may offset any cost savings in its advantages (compact, efficient, etc).

Depending on the quality and composition of the feedstock, the syngas produced from conducting gasification of feedstock in the molten metal may be varied, and will cause operational problems in developing an optimal hydrocarbon product from its second stage catalyst reaction.

Additional and very large quantities of hydrogen, such as those present in water or ambient air, may be required for proper gasification and production of syngas.

In this case, the operation of the molten melt gasifier may require large quantities of water or air either in a steady flow rate or in periodical time blocks, especially in the operation of the containment vessel since temperature regulation is required for safe and reliable performance.

Further, due to the large amounts of electrical energy required for starting and maintaining molten metal, cost of energy may vary due to cost of energy generation. For example, cost of energy production on a marine vessel may be lower than that of producing the energy on land, depending on the fuel source.

In addition, one of the most troubling aspect of locating a high cost plant in a particular territorial domain is the potential of riots, possibility of nationalization of plant assets, and problems of shipping end product to multiple end users within a suitable schedule.

COMMON TERMS

For purposes of this specification and claims the following shall mean:

Marine Vessel, Marine System, Marine Vehicle

Refers to any floatation structure, vehicle, platform, and/or offshore platform. Could be operated in seawater, freshwater, or both. Usually referred to as a ship, ocean-going vessel, barge, hull-vessel, hull, tanker, cargo ship, very large crude carrier (VLCC), floating production, storage and off-loading vessel (FPSO), offshore platforms (semi-submersible, submersible, "rigs") are included in this definition of marine vessel or vessel. Submarines are further included in the definition as same as the term "submersible platform" or vessel.

Gasification or Pyrolysis

Refers to any thermal heating action or process acting on a material to yield gas blend containing elements originally present in the material prior to thermal heating action. In materials containing carbon and moisture, carbon monoxide and hydrogen is produced from this thermal heating action. This gas mixture of carbon monoxide (CO), hydrogen ($H_2$) (along with other gases such as carbon dioxide etc.) is commonly known as "syngas". Generally, a carbonaceous material/feedstock can be converted by thermal means into a syngas blend. Gasification/pyrolysis can be interchangeably used to describe the process of converting the feedstock into syngas.

Carbonaceous Feedstock or Feedstock

Refers to any material containing some carbon. Material, or feedstock, may be in any form and can be either naturally occurring, or a synthetic material, or both, most forms of matter such as solids, liquids and gases are included in the term feedstock or material or carbonaceous material or carbonaceous feedstock. Biomass, municipal waste, municipal solid waste (MSW), scrap waste material, sludge, marine sludge, waste oil, waste sludge, scrap metal, wood, coal, lignite, waste coal, carbon black, rubber, scrap rubber material, rubber derived material, wood chips, charcoal, glass, paper, refuse derived waste, refused derived fuel (RDF), sand, soil material, granular particles, tar sands, shale oil, peat, natural gas, petroleum, crude oil, oil wax, sewage, grass, agriculture derived waste, animal derived waste, are all considered as part of this definition of carbonaceous feedstock.

Hydrocarbon or Hydrocarbon Product

Refers to a hydrocarbon product comprising a carbon number of between $C_1$ to $C_4$, or $C_5$ to $C_{10}$, or $C_{11}$ to $C_{20}$, $C_{21}$ to $C_{30}$, or $C_{31}$ to $C_{60}$, further includes carbon-based fuels comprising a carbon number of between $C_1$ to $C_4$, or $C_5$ to $C_{10}$, or $C_{11}$ to $C_{20}$, $C_{21}$ to $C_{30}$, or $C_{31}$ to $C_{60}$, further includes gasoline, diesel, kerosene, methane, ethane, propane, butane, synthetic natural gas, methanol, light olefins, oxo-alcohols, ethanol.

Fischer-Tropsch Hydrocarbon Products

Refers to a hydrocarbon product comprising a carbon number of between $C_1$ to $C_4$, or $C_5$ to $C_{10}$, or $C_{11}$ to $C_{20}$, $C_{21}$ to $C_{30}$, or $C_{31}$ to $C_{60}$, further includes carbon-based fuels comprising a carbon number of between $C_1$ to $C_4$, or $C_5$ to $C_{10}$, or $C_{11}$ to $C_{20}$, $C_{21}$ to $C_{30}$, or $C_{31}$ to $C_{60}$, further includes gasoline, diesel, kerosene, methane, ethane, propane, butane, synthetic natural gas, methanol, light olefins, oxo-alcohols, ethanol.

Fischer-Tropsch Reactor

Refers to a system that is equipped onboard a marine vessel to perform the conversion, or forming of a predetermined hydrocarbon product from a Syngas blend. The chemical reaction unit is in communication or operationally connected with the thermal conversion plant. Conversion process may or may not make use of a catalyst material or medium to aid in the conversion process to hydrocarbon. Fischer-Tropsch reactor also refers to a methanation reactor, which converts syngas into a hydrocarbon product comprising methane.

Syngas or Syn-Gas or Synthetic Gas

Refers to any gas blend comprising of carbon monoxide (CO) and hydrogen ($H_2$), and may further contain some portion of carbon dioxide ($CO_2$) and other elements. Syngas has a heating value of between 75 to 350 BTU per cubic foot—however, BTU values will vary and may exceed the given range depending on gas element composition ratio.

Electric Power or Electric Current

Refers to a supply of voltage (or electric energy) and can include direct current (DC) or alternating current (AC) power. Voltage may further comprise of a particular voltage phase.

Vessel Powerplant

Refers to the prime mover device or system or engine of the vessel (marine vessel), usually responsible for supplying propulsion power to the vessel, and may feature a mechanical system (sometimes called a marine drive) coupling the engine to the propeller shaft. For marine vessels without a propeller driven propulsion, the marine drive would be the interface wherein energy generated from the powerplant is converted into propulsion for the vessel.

Powerplant

Refers to any power generating device or system. The device or system may produce mechanical power, or electric power, or both, depending on the type of powerplant. Includes reciprocating piston engines, gas turbines, steam turbines, auxiliary generator units, fuel cells, a battery system, rotary engines, combustion boiler that is coupled with an energy conversion apparatus (such as a steam turbine).

Thermal Conversion Plant

Refers to a system that is equipped onboard a marine vessel to perform the conversion of a carbonaceous feedstock into a Syngas blend comprising CO and $H_2$, the thermal conversion plant may be in communication or operationally connected with a variety of parts and sub-systems of the marine vessel, or other related plant system of the overall process of the present invention. The thermal conversion plant uses mainly thermal energy to cause the conversion process, either by convection, radiation, conduction, or a combination thereof.

Chemical Reaction Unit/Chemical Reaction Plant

Refers to a system that is equipped onboard a marine vessel to perform the conversion, or forming of a predetermined hydrocarbon product from a syngas blend. The chemical reaction unit is in communication or operationally connected with the thermal conversion plant. Conversion process may or may not make use of a catalyst material or medium to aid in the conversion process to hydrocarbon.

SUMMARY OF THE INVENTION

The present invention provides a process of manufacturing and distributing a hydrocarbon product to at least one remote site, using a marine vessel, wherein the manufacturing and distributing are implemented onboard.

A marine vessel, such as a suitably adapted floatation vehicle, performs intake and loading of a carbonaceous feedstock up to a predetermined load tonnage, from a first remote site, which may be a port terminal facility, a second marine vessel, or a flotation terminal/structure such as an offshore platform, or a land-based/terrestrial facility. The feedstock may be pre-treated including reducing or increasing its moisture content, either by heat drying (reducing moisture), or fluid spraying or steaming (increasing moisture). The feedstock may also be reduced in physical size by means of a grinder device, or be pulverized into a suitable sieve size. The reduction of the feedstock will enlarge surface area that can be converted into a syngas blend during conversion stage in the thermal conversion plant.

The pre-treated feedstock is then passed into the thermal conversion plant to allow for the feedstock to be thermally converted into a syngas blend comprising CO and $H_2$, however, the syngas blend may further comprise of additional gases such as $CO_2$ etc, depending on the proximate/ultimate analysis and composition of the feedstock used. The present invention may use a mixture of different feedstock types depending on the location where the feedstock is collected for conversion.

The syngas blend may undergo a gas "clean-up" stage where the additional gases are removed to an acceptable level, and passed into the chemical reaction unit/plant, where the syngas is converted into a hydrocarbon product, commonly with the aid of a catalyst. The choice of catalyst, reaction pressure, residency time in the reaction unit, temperature of the syngas feed-stream will determine the hydrocarbon formation of a particular molecular weight. The hydrocarbon product is then isolated, or collected for storage onboard the vessel, which is then subsequently delivered and distributed to a remote site. The marine vessel simultaneously performs delivery of the predetermined product to a remote site while converting the carbonaceous feedstock into the said product using the onboard thermal conversion plant, the chemical reaction unit and the marine vessel's system.

In another embodiment of the present invention, a molten metal is deployed to conduct gasification of a feedstock into syngas, and the syngas is then passed into a second reaction where a catalyst is used to convert the syngas into a hydrocarbon product.

In the second reaction, a Fischer-Tropsch reactor may be deployed. $CO_2$ tail gas from the Fischer-Tropsch reactor is recycled back into the molten metal for gasification.

In the first step, molten metal is deployed as the primary process to conduct gasification of the feedstock into syngas.

In another embodiment of the present invention, feedstock is introduced into the molten metal below its surface for conducting gasification and production of syngas.

In another embodiment of the present invention, a hydrocarbon refining method is disclosed where a heavy or crude (unrefined) hydrocarbon is introduced into the molten metal to conduct gasification and production of syngas.

The syngas is passed into the Fischer-Tropsch reactor for production of a refined (lighter) hydrocarbon product and $CO_2$ tail gas from the Fischer-Tropsch reactor is recycled back into the molten metal for re-gasification.

PRIOR ART

U.S. Pat. No. 6,262,131
U.S. Pat. No. 6,225,358
U.S. Pat. No. 6,277,894
U.S. Pat. No. 6,797,243
US Patent Application 20060189702
US Patent Application 20050106086

BRIEF DESCRIPTION OF THE DRAWINGS

Illustrative preferred embodiments of the present invention will now be described, by way of example, with reference to the accompanying drawings, in which.

DETAILED DESCRIPTION OF THE PREFERRED EMBODIMENTS

Figure 1:
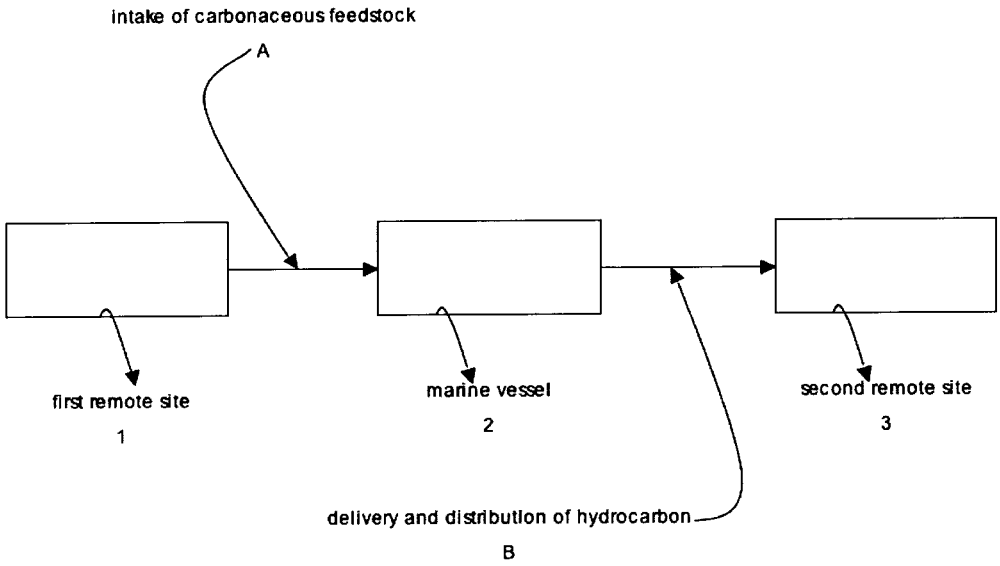
FIG. 1 depicts a schematic of a preferred embodiments of the present invention comprising a marine vessel, a first remote site and a second remote site. The marine vessel performs intake of a carbonaceous feedstock from the first remote site into the vessel, and converts the feedstock into a syngas blend comprising CO and $H_2$, and then converting syngas into a predetermined hydrocarbon product that is delivered and distributed to the second remote site.

With reference to FIG. 1, a marine vessel (2) performs intake and loading of a carbonaceous feedstock (A), from a first remote site (1). The first remote site (1) may be a land-based terrestrial facility, or a second marine vessel, or an offshore platform, or a floating terminal platform. Once the feedstock (A) is completely and satisfactorily loaded onto the vessel (2), it begins its journey to a designated second remote site (3). The vessel (2) will also simultaneously convert the carbonaceous feedstock (A) into a hydrocarbon product (B), which is delivered and distributed to the second mote site (3). The vessel (2) may conduct a second intake of additional carbonaceous feedstock (A) from the second remote site (3), to replenish the feedstock (A) that is consumed to produce the hydrocarbon product (B). Additionally, the marine vessel (2) may also conduct replenishment of the feedstock (A) while at the same time, distributing the hydrocarbon product (B) to the second remote site (3).

Figure 2:
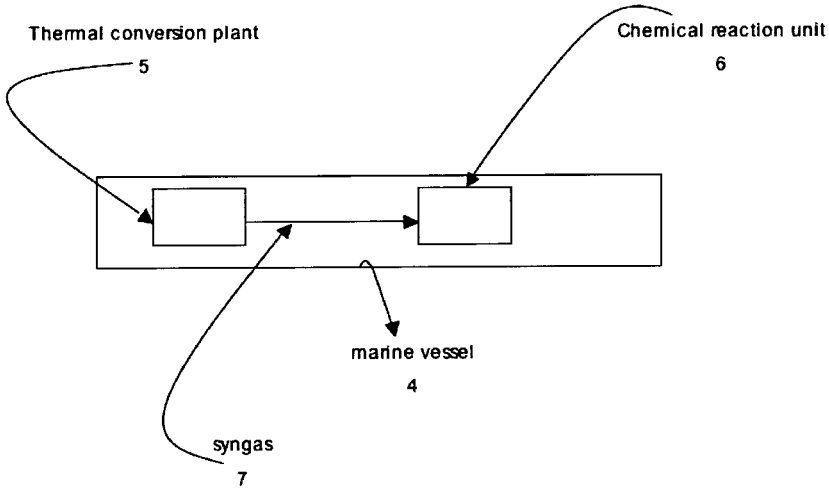
FIG. 2 depicts a schematic of a preferred embodiments of the present invention comprising a marine vessel, the vessel further comprising at least one thermal conversion plant, and at least one chemical reaction unit. The thermal conversion plant converts the carbonaceous feedstock into a syngas blend comprising CO and $H_2$; the chemical reaction unit converts the syngas into a predetermined hydrocarbon product.

With reference to FIG. 1 and FIG. 2, a marine vessel (4) converts a carbonaceous feedstock (A) into a hydrocarbon product (B), by sending the feedstock (A) into the thermal conversion plant (5), and converting the feedstock (A) into a syngas (7), this syngas (7), comprises CO, $H_2$, and is an industrially valuable product by itself. The syngas (7) is passed into a chemical reaction unit (6), to convert the syngas (7) into the hydrocarbon product (B).

In the above preferred embodiment of the present invention, a marine vessel, such as a ship, barge, offshore platform, flotation platform, or specialized vessel like a FPSO, has operational means to perform intake of a feedstock material, and this feedstock material can be varied and diversed, and can include materials such as fossil related material, for example, brown coal, crushed coal, or uncrushed coal, crude oil, heavy oil, waste lubrication oil, waste oil or oil-like material, waste marine oil sludge, tar sands, as well as non-fossil material feedstock such as soil material, garbage, municipal waste, biomass derived material such as grasses, waste agricultural discharge, sewage waste, wood, wood chips, wood derived waste, scrap rubber material, used rubber material, used rubber tires, sea-weed material, animal waste, agricultural waste, palm oil waste effluent, and can also include other materials such as peat, dried grass, unprocessed grass, raw sewage material, top-soil or soil-like sediments, shale oil material, raw natural gas, and any other material containing some value of carbon, hydrogen, or compounds containing carbon, hydrogen.

This feedstock material is stored onboard the vessel and is fed into a pre-processing plant, although some materials such as waste wood chips may be directly fed into the gasification reactor of the present invention.

The gasification reactor onboard the vessel is also called the thermal conversion plant, and has a containment vessel that holds a charge metal, the thermal conversion plant then converts the charge metal into a molten metal melt or molten metallic material.

The charge metal may be steel, iron, metal alloy, mixed scrap metals, zinc, lead, or any other metal that can be subjected to heating or thermal action to cause the metal to be turned into molten metal form.

The thermal conversion plant may further deploy electric arc furnace technology, induction heating, or suitably operated furnace torches to cause thermal heating and or thermal action of the charge metal into its molten form. Furnace torches may include plasma arc torches, gas torches, oxygen-fuel torches etc.

The charge metal may also be thermally treated to turn into molten metal and then transferred into the containment vessel of the thermal conversion plant.

Once the thermal conversion plant's containment vessel is filled with molten metal, or the charge metal in the containment vessel is in its molten form, carbonaceous feedstock is introduced into the containment vessel, and subjected to the high temperature of the molten melt to cause gasification of the feedstock into an intermediate gas, called syngas, comprising of CO (carbon monoxide), $H_2$ (hydrogen), and other by-products depending on the gasification conditions within the containment vessel and quality of the feedstock.

While the invention has been particularly shown and described with reference to a preferred embodiment, those skilled in the art will understand that various changes in form and detail may be made without departing from the spirit and scope of the invention.

The invention claimed is:

1. In a process for producing Fischer-Tropsch hydrocarbon products onboard a marine vessel from at least one gas, liquid or solid carbonaceous feedstock, the improvement comprising the steps of:

conducting gasification in a thermal conversion plant operationally connected to an onboard power plant unit, wherein said step of conducting gasification comprises the sub-steps of:

having a predetermined mass of metal onboard a marine vessel;

heating the mass of metal into a molten metal;

holding the molten metal in a containment vessel;

introducing the carbonaceous feedstock into contact with the molten metal;

producing and yielding an intermediate gas stream from the molten metal; and, collecting the intermediate gas stream;

subjecting the intermediate gas stream to a Fischer-Tropsch reaction for yielding a predetermined hydrocarbon product in a Fischer-Tropsch reactor, the Fischer-Tropsch reactor having at least one recycle line from the Fischer-Tropsch reactor to the thermal conversion plant; and, recycling at least one of $CO_2$ and tail gas from the Fischer-Tropsch reactor to the thermal conversion plant during gasification operations, wherein the thermal conversion plant and the Fischer-Tropsch reactor are onboard the marine vessel.

2. The process of claim 1, wherein the $CO_2$ is recycled from the Fischer-Tropsch reactor to the thermal conversion plant.

3. The process of claim 1, wherein the tail gas is recycled from the Fischer-Tropsch reactor to the thermal conversion plant.

4. In a process for producing hydrocarbon products onboard a marine vessel from at least one gas, liquid or solid carbonaceous feedstock, the improvement comprising the steps of:

conducting gasification in a thermal conversion plant operationally connected to an onboard power plant unit, wherein said step of conducting gasification comprises the sub-steps of:

having a predetermined mass of metal onboard a marine vessel;

heating the mass of metal into a molten metal;

holding the molten metal in a containment vessel;

introducing the carbonaceous feedstock into contact with the molten metal;

producing and yielding an intermediate gas stream from the molten metal; and, collecting the intermediate gas stream;

subjecting the intermediate gas stream to a chemical reaction for yielding a predetermined hydrocarbon product in a chemical reaction plant, the chemical reaction plant having at least one recycle line from the chemical reaction plant to the thermal conversion plant; and, recycling at least one of $CO_2$ and tail gas from the chemical reaction plant to the thermal conversion plant during gasification operations, wherein the thermal conversion plant and the chemical reaction plant are onboard the marine vessel.

5. The process of claim 4, wherein the $CO_2$ is recycled from the chemical reaction plant to the thermal conversion plant.

6. The process of claim 4, wherein the tail gas is recycled from the chemical reaction plant to the thermal conversion plant.

* * * * *